US007150416B2

(12) United States Patent
Martin et al.

(10) Patent No.: US 7,150,416 B2
(45) Date of Patent: Dec. 19, 2006

(54) LIQUID FUEL INJECTION

(75) Inventors: Robert O. Martin, Edmond, OK (US); Harry Eugene Flynn, Edmond, OK (US); Charles A. Natalie, Edmond, OK (US)

(73) Assignee: Tronox LLC, Oklahoma City, OK (US)

( * ) Notice: Subject to any disclaimer, the term of this patent is extended or adjusted under 35 U.S.C. 154(b) by 462 days.

(21) Appl. No.: 10/821,641

(22) Filed: Apr. 9, 2004

(65) Prior Publication Data

US 2006/0144954 A1 Jul. 6, 2006

(51) Int. Cl.
*F02M 59/00* (2006.01)

(52) U.S. Cl. ..... 239/533.2; 239/583; 239/584; 239/533.15; 137/240; 137/606

(58) Field of Classification Search ..... 239/533.2, 239/583, 584, 533.15, 533.1; 137/240, 606
See application file for complete search history.

(56) References Cited

U.S. PATENT DOCUMENTS

| | | | | |
|---|---|---|---|---|
| 2,488,439 | A | 11/1949 | Schaumann | |
| 3,213,918 | A | 10/1965 | Rudzki et al. | |
| 3,381,896 | A | 5/1968 | Winters et al. | |
| 3,561,726 | A | 2/1971 | Iannelli | |
| 3,791,412 | A * | 2/1974 | Mays | 137/614.11 |
| 4,439,400 | A | 3/1984 | Cheng et al. | |
| 4,784,841 | A | 11/1988 | Hartmann et al. | |
| 5,370,527 | A | 12/1994 | Hefling et al. | |
| 5,599,519 | A | 2/1997 | Haddow | |
| 5,823,221 | A | 10/1998 | Stomp et al. | |
| 5,840,112 | A | 11/1998 | Morris et al. | |
| 6,035,837 | A | 3/2000 | Cohen et al. | |
| 6,116,896 | A * | 9/2000 | Joshi et al. | 432/117 |
| 6,207,131 | B1 | 3/2001 | Magyar et al. | |
| 6,269,840 | B1 * | 8/2001 | Beaver | 137/637.4 |
| 6,539,970 | B1 * | 4/2003 | Knowles et al. | 137/238 |

* cited by examiner

*Primary Examiner*—Dinh Q. Nguyen
(74) *Attorney, Agent, or Firm*—Chapin IP Law, LLC; Stanley K. Hill, Esq.

(57) ABSTRACT

Liquid fuel injectors are provided. The liquid fuel injectors allow the injection of a fine spray of liquid fuel. The liquid fuel injectors utilize a schrader valve movable between an open position and a closed position. When the schrader valve is in the closed position fuel flow is blocked and purge gas is allowed to flow through the fuel injectors. When the schrader valve is in the open position, the flow of purge gas is blocked and fuel is allowed to flow through the fuel injector. In this manner, the fuel injectors provide for an immediate and automatic purge of the fuel lines when the fuel flow is shut off.

5 Claims, 3 Drawing Sheets

LIQUID FUEL INJECTION

FIELD OF THE INVENTION

The present invention generally relates to fuel injection technology. More specifically, the present invention relates to improved liquid fuel injection technology that can be advantageously utilized to inject hydrocarbon fuels into hot gases.

BACKGROUND AND SUMMARY OF THE INVENTION

The chloride method for producing titanium dioxide ("$TiO_2$") consists of reacting preheated oxygen gas with titanium tetrachloride ("$TiCl_4$") gas to produce $TiO_2$ particles. Additives in small amounts can be used to control the particle size and structure. Hydrocarbon fuel can be added to the preheated oxygen to increase its temperature further to a final oxygen temperature of about 3000° F. to about 3800° F. prior to the reaction with titanium tetrachloride vapor. The use of supplemental hydrocarbon fuel eliminates the need to build a hot oxygen supply system that can withstand the elevated temperatures that are required.

Hydrocarbon fuels either in the vapor phase or in the liquid phase can be used to increase the oxygen temperature to its final temperature during the $TiO_2$ production process. There exist advantages to using hydrocarbon fuels in the liquid phase. These advantages include, for example, a safer means to deliver the fuel to the reaction zone, the use of low-grade, less costly fuel, and the ability to deliver additives to the reaction zone in a consistent manner by dissolving the additives in the fuel.

However, problems often arise when using liquid fuel injection systems in the production of $TiO_2$. For example, the fuel has to be injected into the hot gas stream in such a way that the heat from the combustion of the fuel does not destroy the injection nozzles or the reactor walls. Additionally, when the system shuts down, an immediate purge of the fuel lines is required to protect the nozzles, as well as prevent pyrolysis of the hydrocarbon fuel in such lines. If the fuel pyrolyzes, solid carbon particles can be produced that block the fuel lines and the fuel delivery system can become unusable.

The present invention provides for liquid fuel injectors that allow the injection of a fine spray of liquid fuel. Liquid fuel injectors of the present invention utilize a schrader valve movable between an open position and a closed position. When the schrader valve is in the closed position fuel flow is blocked and purge gas is allowed to flow through the fuel injectors. When the schrader valve is in the open position, the flow of purge gas is blocked and fuel is allowed to flow through the fuel injector. In this manner, the fuel injectors of the present invention provide for an immediate and automatic purge of the fuel lines when the fuel flow is shut off.

DESCRIPTION OF THE DRAWINGS

The present invention is illustrated by way of example in the following drawings in which like references indicate similar elements. The following drawings disclose various embodiments of the present invention for purposes of illustration only. The drawings are not intended to limit the scope of the invention.

DETAILED DESCRIPTION OF PREFERRED EMBODIMENTS OF THE INVENTION

Figure 1:
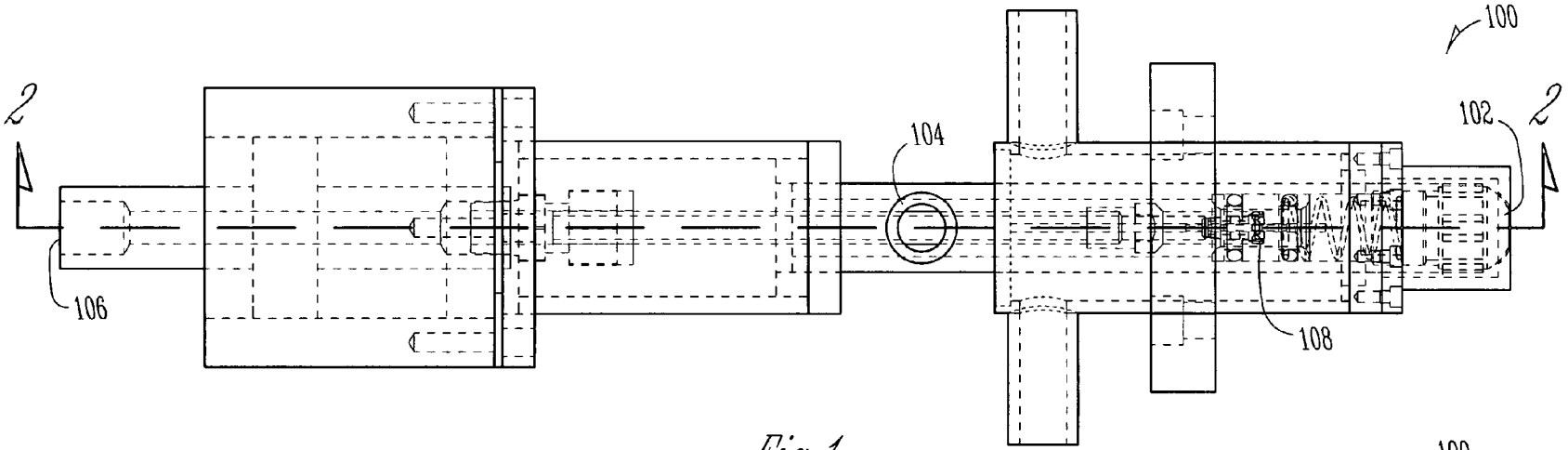
FIG. 1 illustrates a top-down view of a fuel injector of the present invention in the closed position.

In the following detailed description of preferred embodiments of the present invention, reference is made to the accompanying Drawings, which form a part hereof, and in which are shown by way of illustration specific embodiments in which the present invention may be practiced. It should be understood that other embodiments may be utilized and changes may be made without departing from the scope of the present invention.

Fuel injectors of the present invention comprise a nozzle; a purge gas inlet; a liquid fuel inlet; and a schrader valve, movable between an open position and a closed position, wherein the liquid fuel inlet is in communication with the nozzle when the schrader valve is in the open position and the purge gas inlet is not in communication with the nozzle when the schrader valve is in the open position, and wherein the liquid fuel inlet is not in communication with the nozzle when the schrader valve is in the closed position and the purge gas inlet is in communication with the nozzle when the schrader valve is in the closed position. When the schrader valve is in the open position, the fuel injector is said to be on or open. Similarly, when the schrader valve is in the closed position, the fuel injector is said to be off or closed.

During a typical operation, the liquid fuel inlet introduces liquid fuel into the fuel injector and the purge gas inlet introduces purge gas into the fuel injector. When the schrader valve is in an open position, the liquid fuel inlet is in communication with the nozzle and the purge gas inlet is not in communication with the nozzle. That is, when the liquid fuel inlet is in communication with the nozzle, the liquid fuel can flow from the liquid fuel inlet to the nozzle. The liquid fluid will then flow through the nozzle, which causes the liquid fuel to spray into a reaction chamber. When the purge gas inlet is not in communication with the nozzle, the purge gas is blocked from flowing to the nozzle from the purge gas inlet. When the schrader valve is in a closed position, the purge gas inlet is in communication with the nozzle and the liquid fuel inlet is not in communication with the nozzle.

Generally, during a typical operation of the fuel injector, either the liquid fuel is flowing through the nozzle into a reaction chamber or the purge gas is flowing through the nozzle into a reaction chamber. However, while the schrader valve is moving from either the closed position to the open position or from the open position to the closed position, there may be brief moments when neither the liquid fuel nor the purge gas is flowing. When the fuel injector is off, the schrader valve is in the closed position, blocking the liquid fuel from flowing to the nozzle and allowing the purge gas to flow to the nozzle. The flow of purge gas through the fuel injector and through the nozzle effectively cleans the fuel line, preventing carbon from blocking the fuel line or nozzle. The flow of purge gas can also help cool the fuel injector, including the nozzle. Conversely, when the fuel injector is turned on, the schrader valve is moved to the open position, blocking the flow of purge gas to the nozzle and allowing the flow of liquid fuel to the nozzle. When fuel is no longer needed, the fuel injector is turned off by moving the schrader valve into the closed position, stopping the flow of fuel, and immediately allowing the flow of purge gas.

Turning now to the drawings, FIG. 1 shows a top-down view of a fuel injector 100 according to the present invention. The fuel injector 100 comprises a nozzle 102, a purge gas inlet 104, a liquid fuel inlet 106, and a schrader valve 108. Nozzles known in the art may be advantageously used in fuel injectors of the present invention. For example, fuel injectors according to the present invention can be produced using nozzles available from Wm. Steinen Manufacturing Company. Schrader valves are also known in the industry. Schrader valves are a type of valve fitting that opens when depressed. Schrader valves are known to be used in tire valve stems, on air conditioning hoses, and on the fuel rails of some fuel injection systems. Fuel injectors of the present invention can be produced using Schrader valves available from Schrader Bridgeport, Inc., for example.

Figure 2:
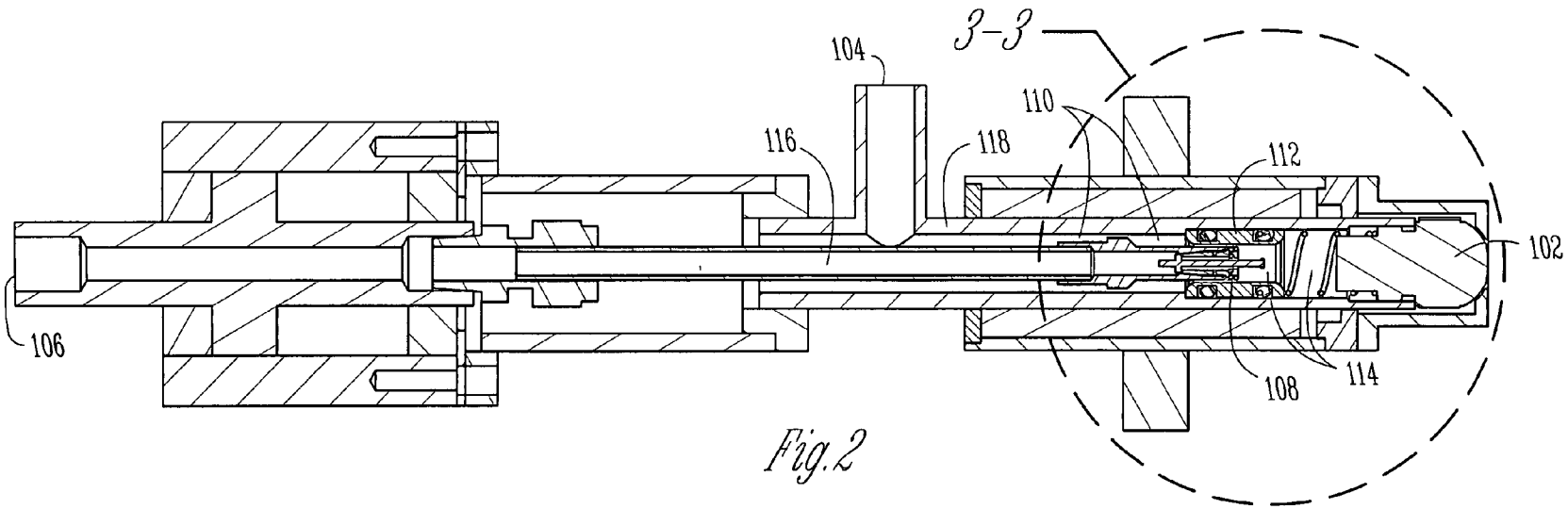
FIG. 2 illustrates a cross-sectional view of the fuel injector shown in FIG. 1.

FIG. 2 shows a cross-sectional view of the fuel injector 100 of FIG. 1. The schrader valve 108 is in the closed position. Purge gas enters the fuel injector 100 through the purge gas inlet 104 and flows into the space 110 between the fuel tube 116 and the casing 118 of the fuel injector 100. The purge gas passes through the space 110 between the fuel tube 116 and the casing 118 of the fuel injector 100 and continues through a space between the fuel tube 116 and the valve seat 112, the purge gas then continuing into the space 114 between the schrader valve 108 and the nozzle 102 and then passing through the nozzle 102 into a reaction chamber (not shown).

Figure 3:
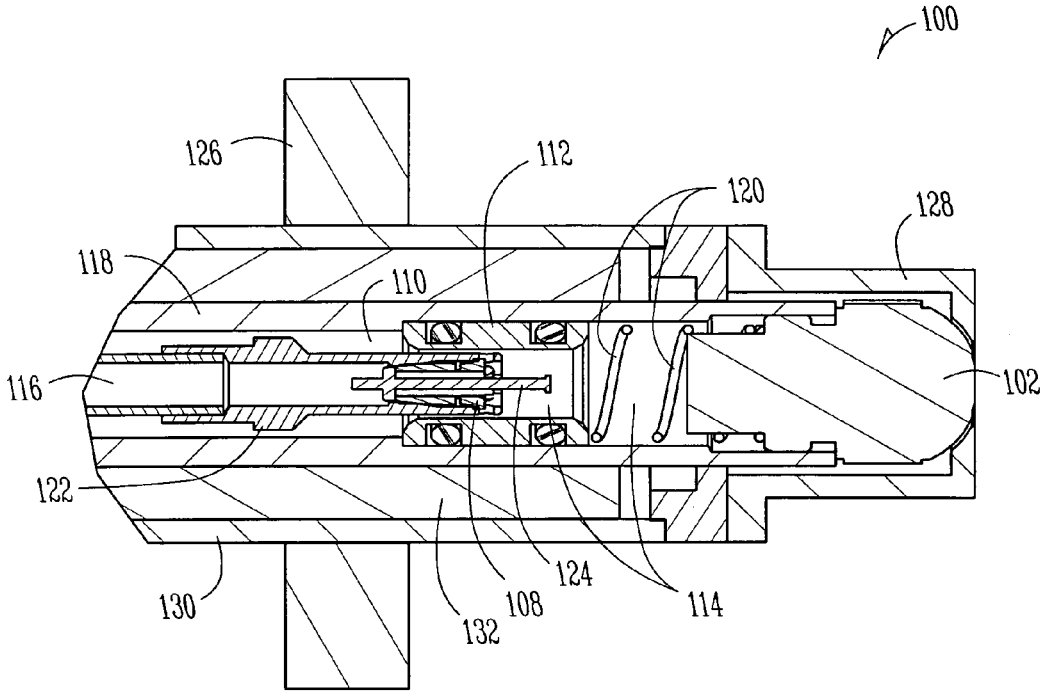
FIG. 3 illustrates an enlarged view of a portion of the fuel injector shown in FIG. 1 and FIG. 2.

FIG. 3 shows an enlarged view of the nozzle end of the fuel injector 100 shown in FIG. 1 and FIG. 2. As shown in FIG. 3, the schrader valve 108 is positioned inside the fuel tube 116 and at the end of the fuel tube 116 nearest the nozzle 102. One manner of positioning the schrader valve 108 into the fuel tube 116 is simply to screw the schrader valve 108 into the end of the fuel tube 116. There must be sufficient space between the fuel tube 116 and the valve seat 112 to allow the purge gas to flow through on its way to the nozzle 102. In one preferred embodiment, this space is about three one-hundredths (0.03) of an inch. That is, since both the fuel tube 116 and the valve seat 112 are cylindrically shaped, the internal radius of the valve seat 112 is about three one-hundredths (0.03) of an inch larger than the external radius of the fuel tube 116. While the schrader valve 108 is in the closed position, the spring 120 helps maintain the valve seat 112 away from the nozzle.

As the fuel injector 100 is turned on or opened, the fuel tube 116 is pushed toward the nozzle 102. As the fuel tube 116 moves forward, the protrusion 122 on the fuel tube 116 contacts the valve seat 112. The contact of the protrusion 122 on the fuel tube 116 with the valve seat 112 closes the pathway for the purge gas, effectively shutting off the purge gas. When the protrusion 122 on the fuel tube 116 is in contact with the valve seat 112, the stem 124 of the schrader valve 108 will protrude from the valve seat 112. By protruding, it is meant that the distance from stem 124 of the schrader valve 108 to the nozzle 102 is less than the distance from the valve seat 112 to the nozzle 102. As the fuel tube 116 continues to move toward the nozzle 102, the fuel tube 116 pushes the valve seat 112 toward the nozzle 102, depressing the spring 120. The fuel tube 116 continues forward, contacting the schrader valve stem 124 with the nozzle 102. The fuel tube 116 continues forward, depressing the schrader valve stem 124. When the schrader valve stem 124 is depressed the schrader valve 108 is open and fuel is allowed to flow into the fuel tube from the fuel inlet 106 (shown in FIG. 1 and FIG. 2) through the fuel tube 116, through the schrader valve 108, and through the nozzle 102 into a reaction chamber (not shown).

Figure 4:
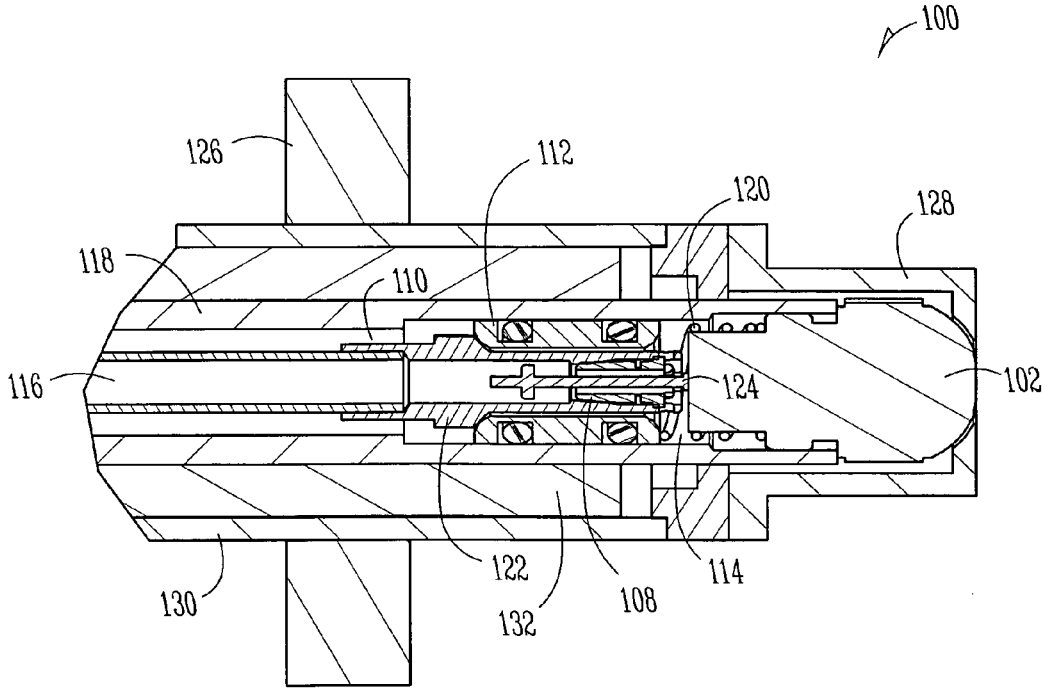
FIG. 4 illustrates the fuel injector of FIG. 3 in the open position.

FIG. 4 shows the fuel injector 100 of FIG. 3 with the schrader valve 108 in the open position. As shown in FIG. 4, the protrusion 122 on the fuel tube 116 is in contact with the valve seat 112 and the valve seat 112 has been pushed forward (to the right in FIG. 4), depressing the spring 120 and depressing the valve stem 124 by virtue of the valve stem's 124 contact with the nozzle 102. The schrader valve 108 is open and fuel is allowed to flow from the fuel tube 116, through the schrader valve 108, and through the nozzle 102 into a reaction chamber (not shown). The fuel continues to flow through the nozzle 102 into the reaction chamber (not shown) until the fuel injector 100 is shut off or closed.

FIGS. 1–5 do not illustrate the precise flow path that the fuel or purge gas takes when passing through the nozzle 102. The precise flow path through nozzles used in fuel injectors of the present invention is not a critical aspect of the present invention and may vary depending on the specific type or brand of nozzle used.

The fuel injector 100 is shut off or closed by retracting the fuel tube. For example, to shut off the fuel injector 100 shown in FIG. 4, the fuel tube 116 is retracted, allowing the spring 120 to push the valve seat 112 back to its closed position as the fuel tube 116 is retracted. As the schrader valve 108 is retracted the schrader valve stem 124 is no longer depressed and the schrader valve 108 closes, shutting off the flow of liquid fuel. The fuel tube continues to retract until the valve seat 112 reaches its closed position, at which point the valve seat 112 is blocked from retracting further. At this point, the fuel tube 116 continues to be retracted a little further so that the protrusion 122 on the fuel tube 116 is no longer in contact with the valve seat 112, thereby allowing purge gas to flow between the schrader valve 108 and the valve seat 112 and through the nozzle 102, purging the liquid fuel from the fuel injector 100.

The fuel injector 100 is a preferred embodiment of the present invention in that the schrader valve stem 124 is depressed, thereby opening the schrader valve 108, by pressing the stem 124 against the nozzle 102. This places the schrader valve 108 in close proximity to the nozzle 102 when the schrader valve 108 is opened. Consequently, the volume of the space between the schrader valve 108 and the nozzle 102 is very small and this space can contain only a small amount of fuel. Thus, when the schrader valve 108 is moved to the closed position, only a small amount of fuel needs to be purged, and therefore, the fuel can be purged quickly. This is an advantage over fuel injectors of the prior art, as fuel injectors of the prior art can take several seconds to purge relatively large amounts of fuel.

However, the present invention is not so limited. Fuel injectors of the present invention could use other means for depressing the schrader valve stem. For example, it is contemplated that fuel injectors of the present invention could utilize an alternate structure to depress the schrader valve stem. The alternate structure can be placed near the nozzle such that the stem contacts the alternate structure instead of the nozzle. This alternate structure could be made of a material more durable than the nozzle and save wear and tear on the nozzle.

Any appropriate means can be employed to move or push the fuel tube toward the nozzle when moving the schrader valve from the closed position to the open position. One preferred method is to allow the pressure in the liquid fuel line to push the fuel tube toward the nozzle, moving the schrader valve from the closed position to the open position. For example, a fuel valve can be used, as is known in the art, to open the fuel line leading to the fuel injector, creating a pressure in the fuel line sufficient to push the fuel tube toward the nozzle and move the schrader valve to the open position. Another preferred method utilizes an air cylinder to both extend the fuel tube toward the nozzle, moving the schrader valve to the open position, and retract the fuel tube, moving the schrader valve to the closed position.

The portion of the fuel injector that protrudes into the reaction chamber or the furnace is typically covered by a heat shield to protect the internal parts of the fuel injector from excessive heat. Heat shields are known in the art and fuel injectors of the present invention can be advantageously utilized in conjunction with heat shields known in the art. For example, the portion of the fuel injector 100 that protrudes into the reaction chamber (not shown) is covered by a heat shield 128.

Figure 5:
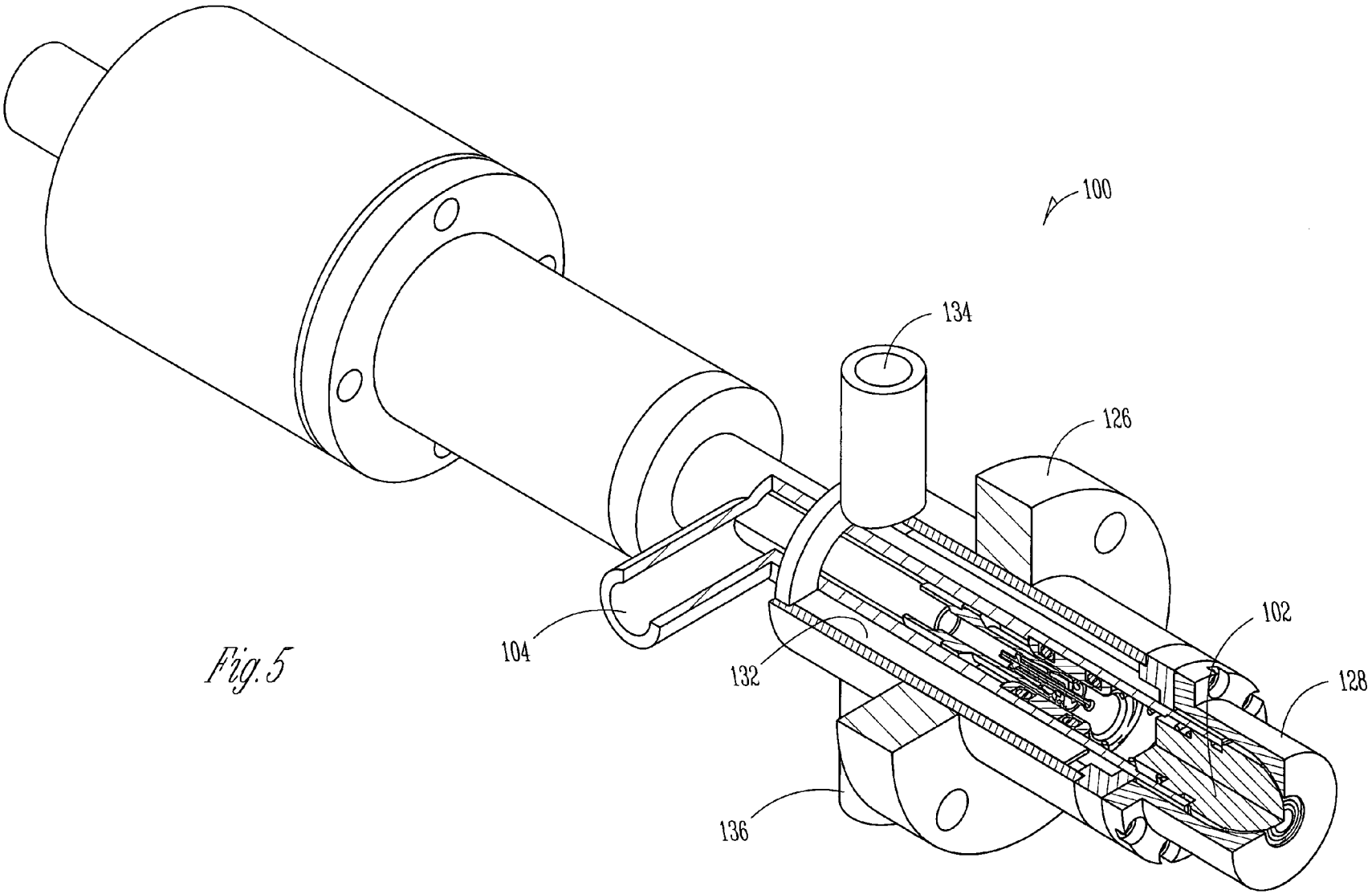
FIG. 5 shows a cut-away view of the fuel injector of FIG. 1–4.

Fuel injectors of the present invention may also comprise a casing that forms a chamber adapted to have a suitable coolant circulated there through. Such casings and their corresponding chambers are frequently referred to as cooling jackets. When the coolant is water, the cooling jacket is referred to as a cooling water jacket. Cooling jackets suitable for use with fuel injectors of the present invention are known in the art. For example, the casing 130 houses cooling water baffles 132 adapted to have a suitable coolant circulated there-through. FIG. 5 illustrates the position of a cooling water inlet 134 and a cooling water exit 136 as well as one of the cooling water baffles 132. Water enters the cooling water inlet 134, absorbs heat while traveling through the cooling water baffles 132, and then exits through the cooling water exit 136. In preferred embodiments of the present invention, the heat shield will conduct heat into a cooling water jacket.

In one preferred embodiment of the present invention, fuel injectors of the present invention are used to spray hydrocarbon fuel into a reaction chamber where the fuel reacts with preheated oxygen, generating sufficient heat to raise the temperature of excess unreacted oxygen to a temperature of about 3000° F. to about 3800° F. The heated oxygen is then reacted with titanium tetrachloride to produce titanium dioxide. In this embodiment, preferred hydrocarbon fuels include toluene, propane, and blends thereof. Preferred purge gases include nitrogen and air.

In accordance with the present invention, improved fuel injectors are provided. The fuel injectors comprise a purge mechanism that causes a virtually immediate and automatic purge of the fuel lines when the fuel is shut off. While the present invention has been described in detail with respect to specific embodiments thereof, it will be appreciated that those skilled in the art, upon attaining an understanding of the foregoing, may readily conceive of alterations to, variations of and equivalents to these embodiments. Accordingly, the scope of the present invention should be assessed as that of the appended claims and by equivalents thereto.

What is claimed is:

1. A liquid fuel injector, comprising:

a nozzle;

a purge gas inlet;

a liquid fuel inlet; and a schrader valve, movable between an open position and a closed position, wherein the liquid fuel inlet is in communication with the nozzle when the schrader valve is in the open position and the purge gas inlet is not in communication with the nozzle when the schrader valve is in the open position, and wherein the liquid fuel inlet is not in communication with the nozzle when the schrader valve is in the closed position and the purge gas inlet is in communication with the nozzle when the schrader valve is in the closed position.

2. The liquid fuel injector of claim 1, wherein the schrader valve comprises a valve stem that is depressed by virtue of the stem's contact with the nozzle when the schrader valve is in the open position.

3. The liquid fuel injector of claim 1, further comprising a heat shield protecting the nozzle.

4. The liquid fuel injector of claim 3, further comprising a cooling water jacket, wherein the heat shield conducts heat into the cooling water jacket.

5. The liquid fuel injector of claim 1, further comprising a spring mechanism, wherein the spring mechanism is positioned to move the schrader valve from the open position to the closed position.

* * * * *